US006108896A

United States Patent [19]

Gignac et al.

[11] Patent Number: 6,108,896

[45] Date of Patent: Aug. 29, 2000

[54] PROCESS AND TOOL ASSEMBLY FOR RIVETING PARTS

[75] Inventors: Jacques Gignac, Lille; Patrice Maurel, Seclin; Arnaud Risbourg, Tourgoing, all of France

[73] Assignee: Avions Marcel Dassault Breguet Aviation, Vaucresson, France

[21] Appl. No.: 08/322,370

[22] Filed: Oct. 13, 1994

Related U.S. Application Data

[63] Continuation of application No. 07/533,761, Jun. 6, 1990, abandoned.

[30] Foreign Application Priority Data

Jun. 6, 1989 [FR] France ..... 89 07439

[51] Int. Cl.[7] ..... B21J 15/02; B21J 15/10

[52] U.S. Cl. ..... 29/524.1; 29/26 A; 29/243.54; 29/525.06; 227/27; 227/51; 227/58; 227/69; 227/152; 901/41

[58] Field of Search ..... 227/14, 27, 51, 227/53, 58, 69, 111, 131, 147, 2, 5, 6, 152; 29/26 A, 34 B, 39, 524.1, 525.2, 243.54, 243.53, 525.06; 901/41

[56] References Cited

U.S. PATENT DOCUMENTS

| | | | |
|---|---|---|---|
| 3,562,893 | 2/1971 | Winslow et al. | 227/51 X |
| 3,704,506 | 12/1972 | Orr et al. | 29/243.54 |
| 4,273,280 | 6/1981 | Birkhofer et al. | 227/131 X |
| 4,326,903 | 4/1982 | Summo | 227/51 X |
| 4,662,556 | 5/1987 | Gidlund | 227/51 X |
| 4,676,422 | 6/1987 | Gidlund et al. | 227/51 |
| 4,762,261 | 8/1988 | Hawly et al. | 227/111 X |
| 4,815,193 | 3/1989 | Gutnik | 29/509 |
| 4,854,491 | 8/1989 | Stoewer | 227/58 |
| 4,862,043 | 8/1989 | Zieve | 29/243.54 X |
| 4,885,836 | 12/1989 | Bonomi et al. | 227/51 X |
| 4,919,321 | 4/1990 | Rydström et al. | 227/51 X |
| 4,955,119 | 9/1990 | Bonomi et al. | 227/58 X |
| 4,995,148 | 2/1991 | Bonomi et al. | 29/26 A |

FOREIGN PATENT DOCUMENTS

| | | |
|---|---|---|
| 0301964 | 2/1989 | European Pat. Off. . |
| 2598640 | 11/1987 | France . |
| 2148170 | 5/1985 | United Kingdom . |

*Primary Examiner*—Clark F. Dexter
*Attorney, Agent, or Firm*—Stevens, Davis, Miller & Mosher, L.L.P.

[57] ABSTRACT

Tool assembly for riveting parts, comprising: a first and a second frame (2, 5) capable of being mounted on a shaped structure "C" or on separate robot arms (60, 61); a pair of sheet-holding devices (3, 6) each mounted on one of the frames and at least one of each is provided with a device (11) for displacing it relative to the corresponding chassis with a force corresponding to the clamping provided for holding the parts to be riveted during drilling; at least one drill (20, 21) mounted on a frame, a device (41) for placing a rivet (40) in a hole drilled by the drill, this device being carried by a frame; a percussion riveting hammer (51) carried by a frame and an associated counter-piece (54) carried by the other frame, integral with a reaction dolly (52). The elements carried by each frame are all capable of being displaced between an active position and a rest position.

12 Claims, 8 Drawing Sheets

ACTUATOR
22A

PROCESS AND TOOL ASSEMBLY FOR RIVETING PARTS

This application is a Continuation of application Ser. No. 07/533,761, filed Jun. 6, 1990, now abandoned.

PRIOR ART

The invention relates to a tool assembly for riveting parts, in particular for the assembly of metal sheets by riveting, and to a process for assembling parts using this assembly.

The riveting of metal sheets usually comprises drilling the metal sheets, positioning the holes obtained to coincide if the metal sheets were not already held in place during drilling, introducing a rivet and plastically deforming the latter at one of its ends or at both ends to form the joint.

The deformation of the rivet can be effected by hammering or by pressing. In the case of hammering, a mass driven at a certain speed repeatedly strikes the end of the rivet while the opposite end of the rivet is supported on a mass of high inertia, called the "dolly". In the case of pressing, a tool exerts a considerable continuous force on the end of the rivet to be deformed and the reaction is exerted by an anvil in contact with the opposite end of the rivet and carried by a sturdy part in the form of a C and called a "C", which connects this anvil to the pressing tool.

Due to the fact that it generates shocks and vibrations, riveting by hammering is confined to manual operations of low productivity. Riveting by pressing lends itself better to automated operations but the mass of the C, a sturdy part which frequently has to transmit a force of several tons between its ends, necessitates heavy installations, thus increasing the cost and the duration of the operation.

To speed up the operations it has been proposed, in European Patent No. 0,301,964 to mount a plurality of tools, for example a metal sheet grip and a pressing hammer, on a frame situated at one of the ends of the C and the metal sheet grip and the opposing snap on a frame situated at the other end, making it possible to save time between the successive phases of the operation but not reducing the mass of the C which carries these frames.

OBJECT OF THE INVENTION

It is the object of this invention to provide an apparatus which permits significant savings in cost by making it possible to lighten the C considerably or even to do away with it by using robot arms.

SUMMARY OF THE INVENTION

To obtain this result, the invention provides a tool assembly for riveting parts, comprising:

- a first and a second frame capable of being mounted on a common C or on separate robot arms,
- a pair of sheet-holding devices each mounted on one of the frames and at least one of which is provided with means for displacing it relative to the corresponding chassis with a force corresponding to the clamping provided for holding the parts to be riveted during drilling,
- at least one drill mounted on a frame and provided with means for displacing it between an active position and a rest position,
- means for placing a rivet in a hole drilled by the drill, these means being carried by a frame and provided with means for displacing them between an active position and a rest position,

- a riveting tool carried by a frame and an associated counter-piece carried by the other frame.

This assembly having as its principal feature that:

- the riveting tool is a percussion-riveting hammer and is provided with means for displacing it between an active position and a rest position,
- the counter-piece is integral with a reaction dolly and the assembly is provided with means for displacing it between an active position and a rest position.

Preferably, the sheet-holding devices, the means for placing the rivet, the riveting tool and the reaction dolly are displaceable along the axis of the hole and the other tools perform at least one displacement perpendicular to the axis in order to pass from the rest position to the active position.

Preferably too, the different movements of the tools are controlled by pneumatic cylinders. In this way, any hydraulic equipment on the working heads is avoided.

Furthermore, at least one of the frames advantageously carries a means for placing a sealing agent, this means being displaceable between an active position and a rest position.

The invention also provides a process for assembling parts which comprises the steps of mounting each of the frames of an assembly of the above type on a separate robot arm, of bringing the two sheet-holding devices into contact with the opposite faces of the parts to be assembled by displacing the robot arms, locking the brakes of the robots and clamping the parts to be assembled against one another with a force sufficient to prevent their relative displacement during the subsequent drilling, the reaction to this force being provided by the locked robot arms, and proceeding to drill and rivet the parts thus clamped.

BRIEF DESCRIPTION OF THE FIGURES

The present invention will now be described in more detail with the aid of a practical example illustrated by the drawings, of which.

DETAILED DESCRIPTION OF THE INVENTION

Figure 1:
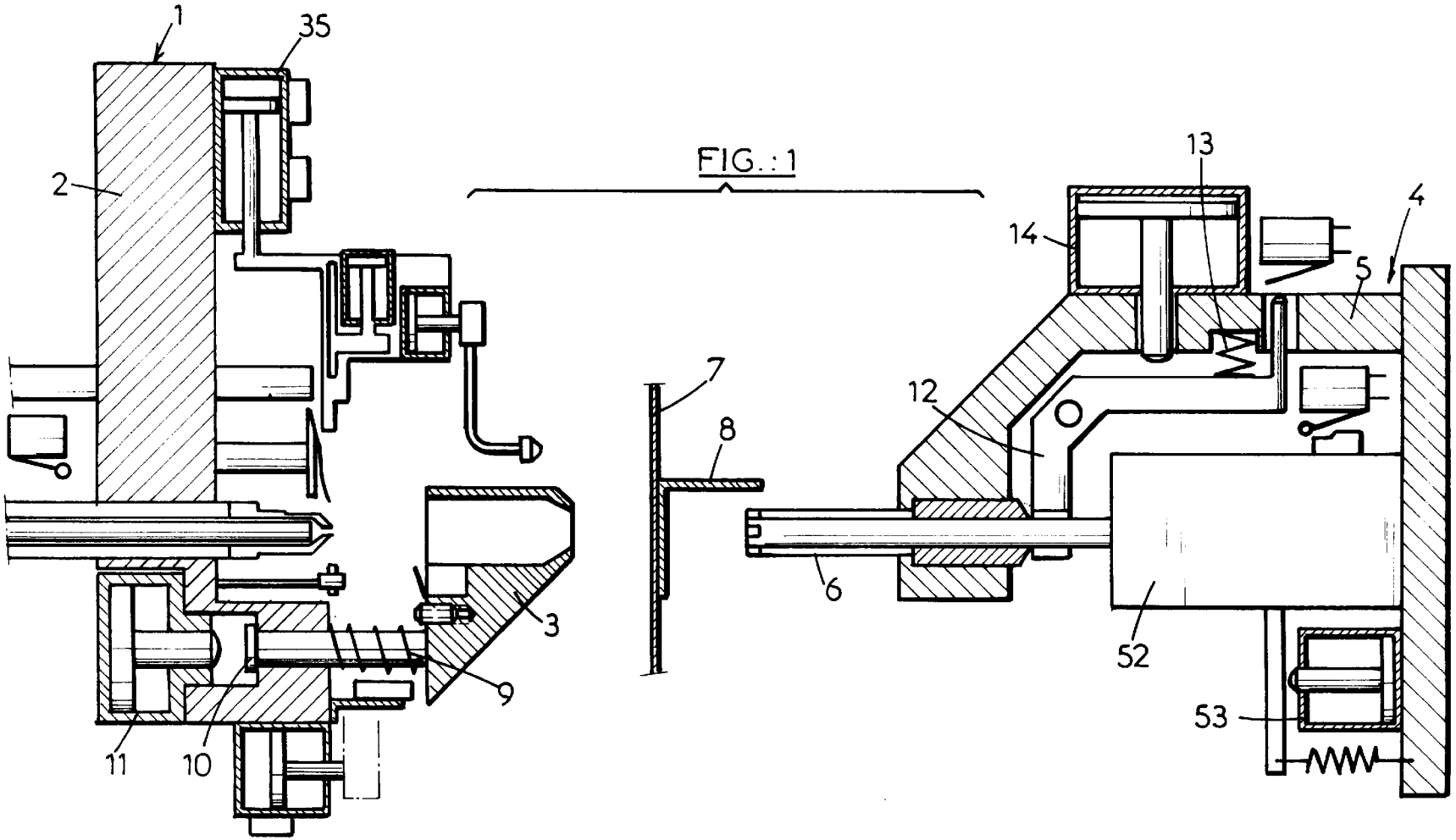
FIGS. 1 to 7 are schematic sections showing the successive phases of a riveting operation.

As has been understood, the tool assembly is formed by two subassemblies, each consisting of a chassis and a certain number of tools carried by this chassis. Following the customary terminology of the profession, these subassemblies are called "working heads". A first working head 1 comprises a frame 2 which carries, inter alia, a first sheet-holding device 3. A second working head 4 likewise comprises a frame 5, which carries the second sheet-holding device 6.

In the waiting position of FIG. 1, the two working heads are at a distance from one another and the sheet-holding devices 3, 6 are at a distance from the metal sheets 7, 8 which are to be assembled. The sheet-holding device 3 is mounted so as to be slidable relative to the frame 2, a spring 9 tending to push it in the direction of the metal sheets 7, 8. A stop 10 limits its displacement relative to the frame. Via the sheet-holding device 3, a cylinder 11 is capable of exerting a clamping force on the metal sheets 7, 8. Sheet-holding device 6, for its part, is pushed towards the metal sheets 7, 8 via a lever 12, itself pushed by a spring 13, and a cylinder 14 can likewise push the sheet-holding device 6 so that it exerts a given clamping force on the metal sheets 7, 8.

Figure 2:
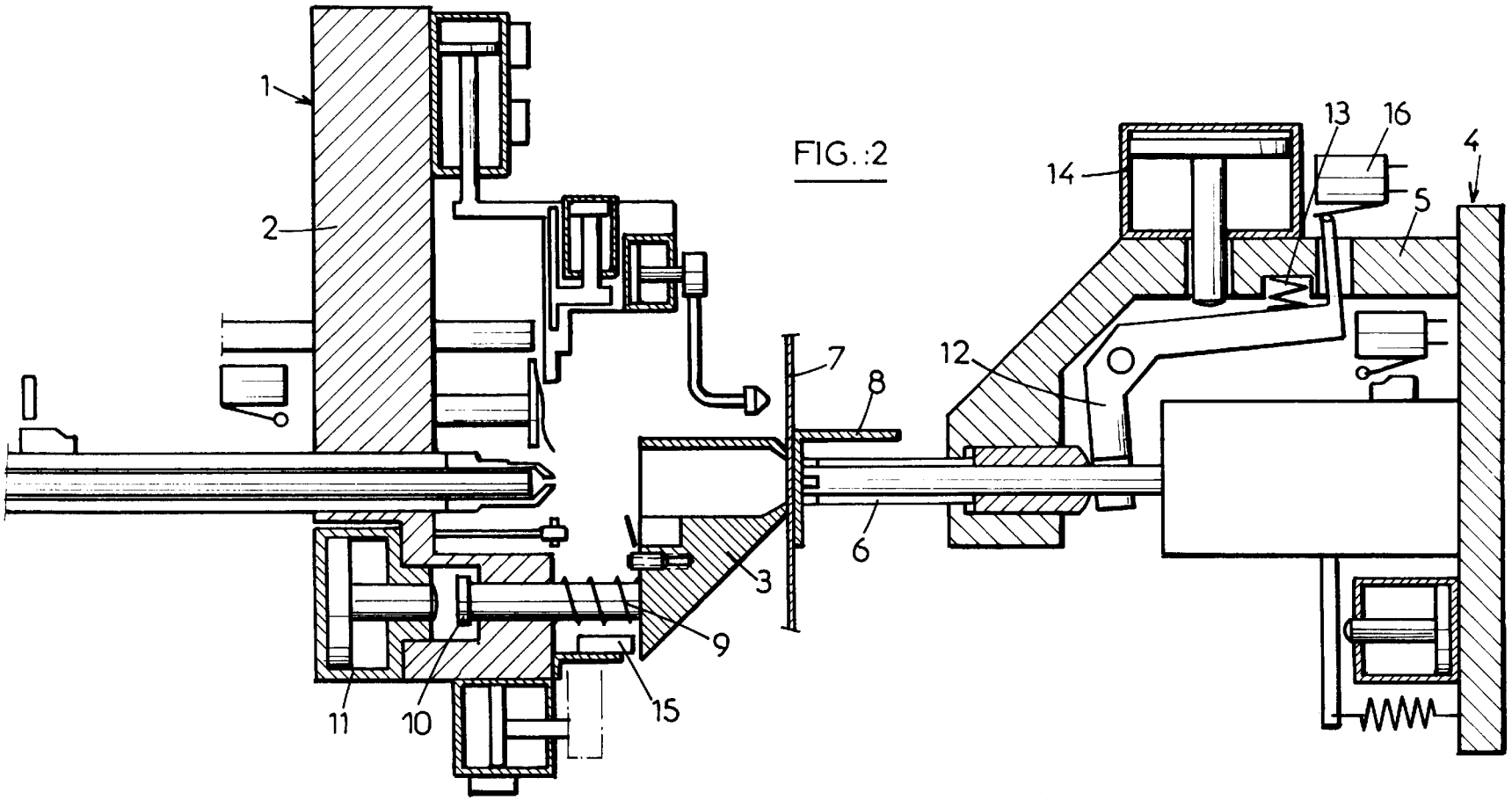

In the so-called "pregripping" position of FIG. 2, the working heads 1 and 4 have been brought closer together and the sheet-holding devices 3 and 6 have come into contact with the metal sheets 7, 8 and have recoiled, compressing the springs 9 and 13 slightly. Contactors 15 and 16 have given the pregripping signals, which control the subsequent "gripping" phase.

It should be noted that from this moment the frames 2 and 5 are immobilized for the subsequent part of the operation.

Figure 3:
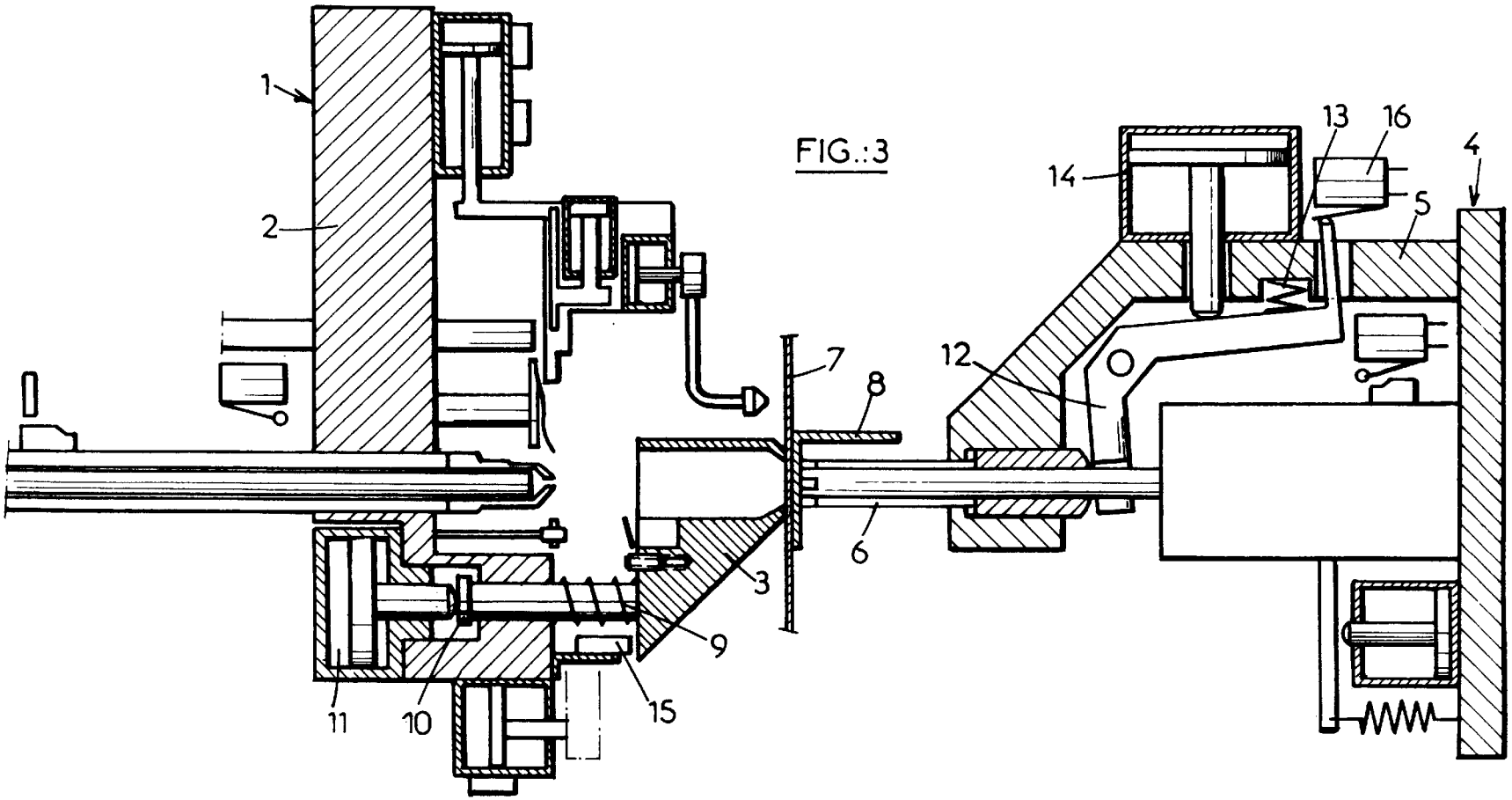

In the situation of FIG. 3, the sheet-holding devices 3 and 6 have virtually not moved at all but the cylinders 11 and 14 have been actuated with a given force to ensure that the metal sheets 7, 8 are clamped under a force which may be of the order of 1500 N.

Figures 4, 10:
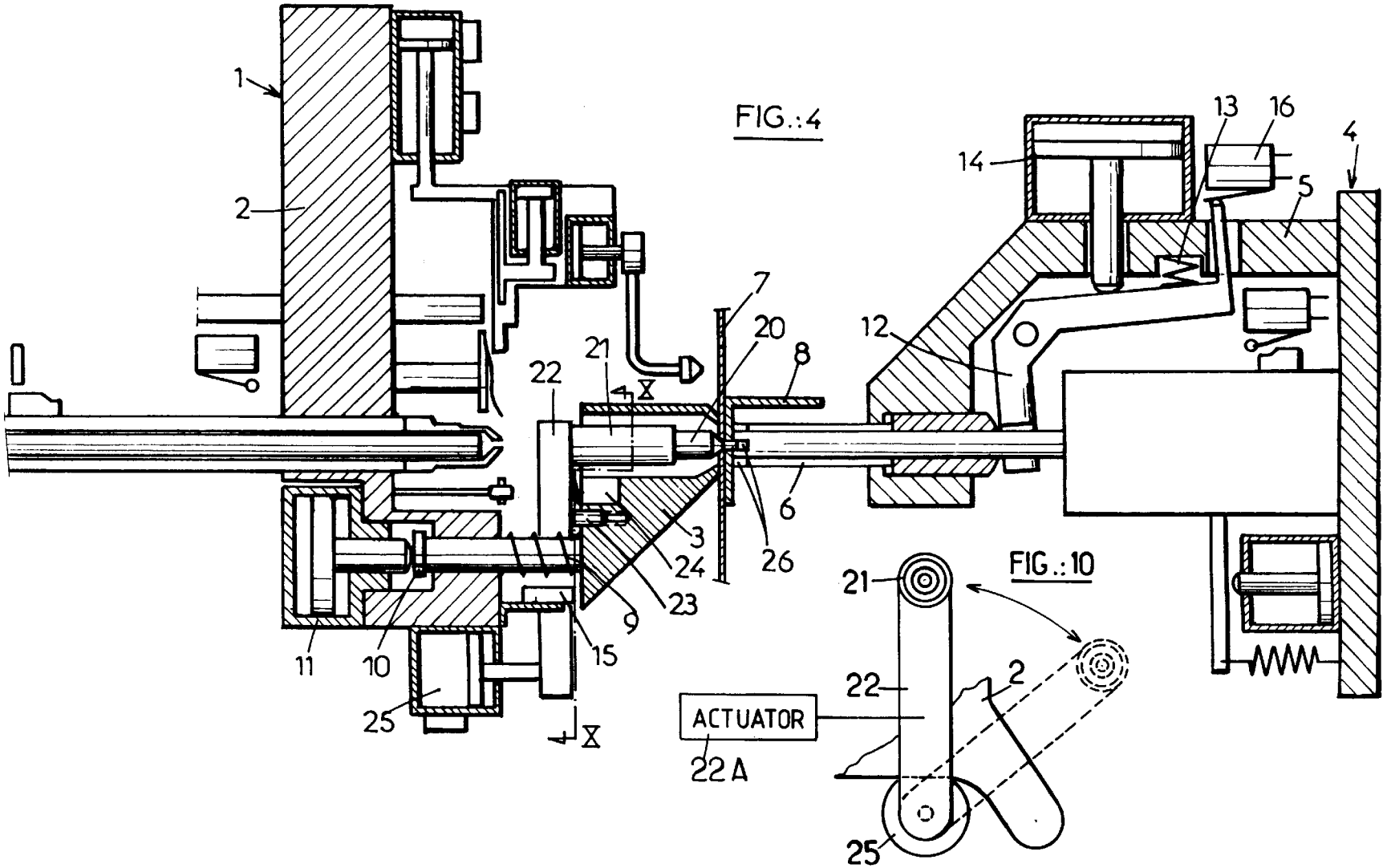
FIG. 10 is a diagrammatic side view taken along line 10—10 of FIG. 4.

The drilling operation is represented in FIG. 4. The drilling tool 20 is driven in rotation by a pneumatic motor 21 and the assembly is mounted on an articulated arm 22 which allows the drilling tool to be brought into the axis of the sheet-holding device 3. The cylinders 11 and 14 are continuously actuated, such that the metal sheets 7 and 8 are held clamped against one another with a force of the order of 1500 N, capable of permitting the successive drilling of the two metal sheets in a single operation without the risk of the formation of burrs etc. between the sheets, such that it will not then be necessary to carry out supplementary preparatory work on the holes. To obtain a countersunk hole, a tool 20 of cylindro-conical shape is used, its penetration depth being controlled by an adjustable stop 23 and a contactor 24. A cylinder 25 acting on the articulated arm 22 pushes the drilling tool 20 in a conventional manner in the direction of the metal sheets 7 and 8. Its power supply is controlled, in particular, by the contactor 24. The chips are discharged through vents 26 which pass radially through the wall of the second sheet-holding device 6. FIG. 10 is a diagrammatic side view of a portion of FIG. 4, showing in solid line the connection between arm 22 and motor 21 when the arm is in the FIG. 4 position and showing in dotted line the connection between arm 22 and motor 21 when the arm is in the FIG. 3 position, the movement between these positions being accomplished by an actuator 22A.

Figure 5:
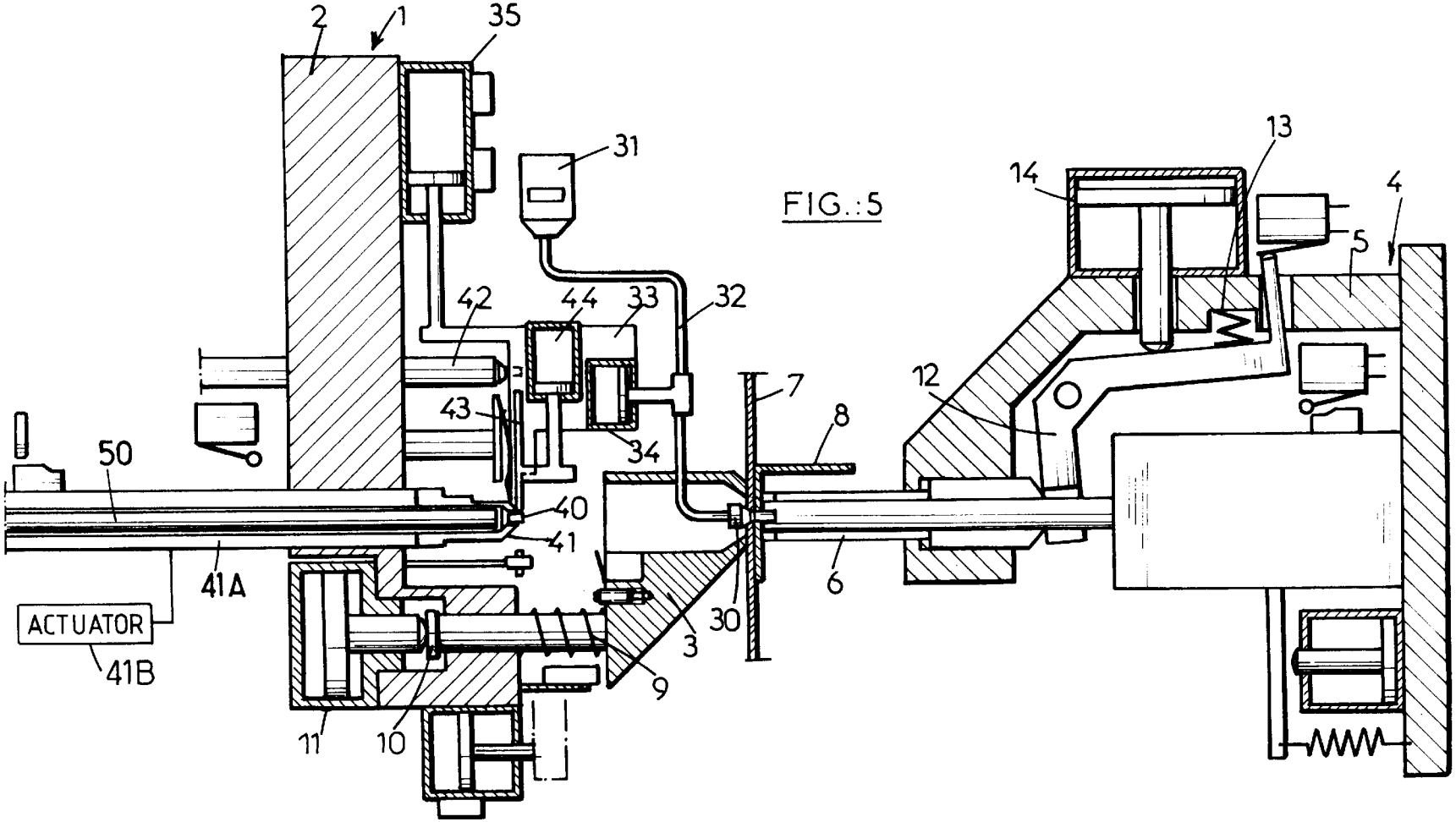

FIG. 5 shows another phase of the operation, namely the placing of a sealing agent on the countersink of the hole. A nozzle 30 is connected to a reservoir of sealing agent 31 by a rigid pipe 32. The whole is carried by a support 33 equipped with two cylinders, one 34 being capable of displacing the nozzle along the axis of the hole and the other 35 displacing the whole in a perpendicular direction so as to bring the nozzle into the active position or withdraw it from the latter. This cylinder 35 is fixed to the frame 2.

Simultaneously with the placing of the sealing agent, a rivet 40 is transferred on a set of tongs 41, coaxial with the hole, from an intermediate storage device 42 by virtue of a transfer means 43, movable linearly by virtue of a cylinder 44 in a direction perpendicular to the axis of the hole. A tubular member 41A supports tongs 41 and an actuator 41B is connected to member 41A for moving the tongs along the axis of the hole.

Figure 6:
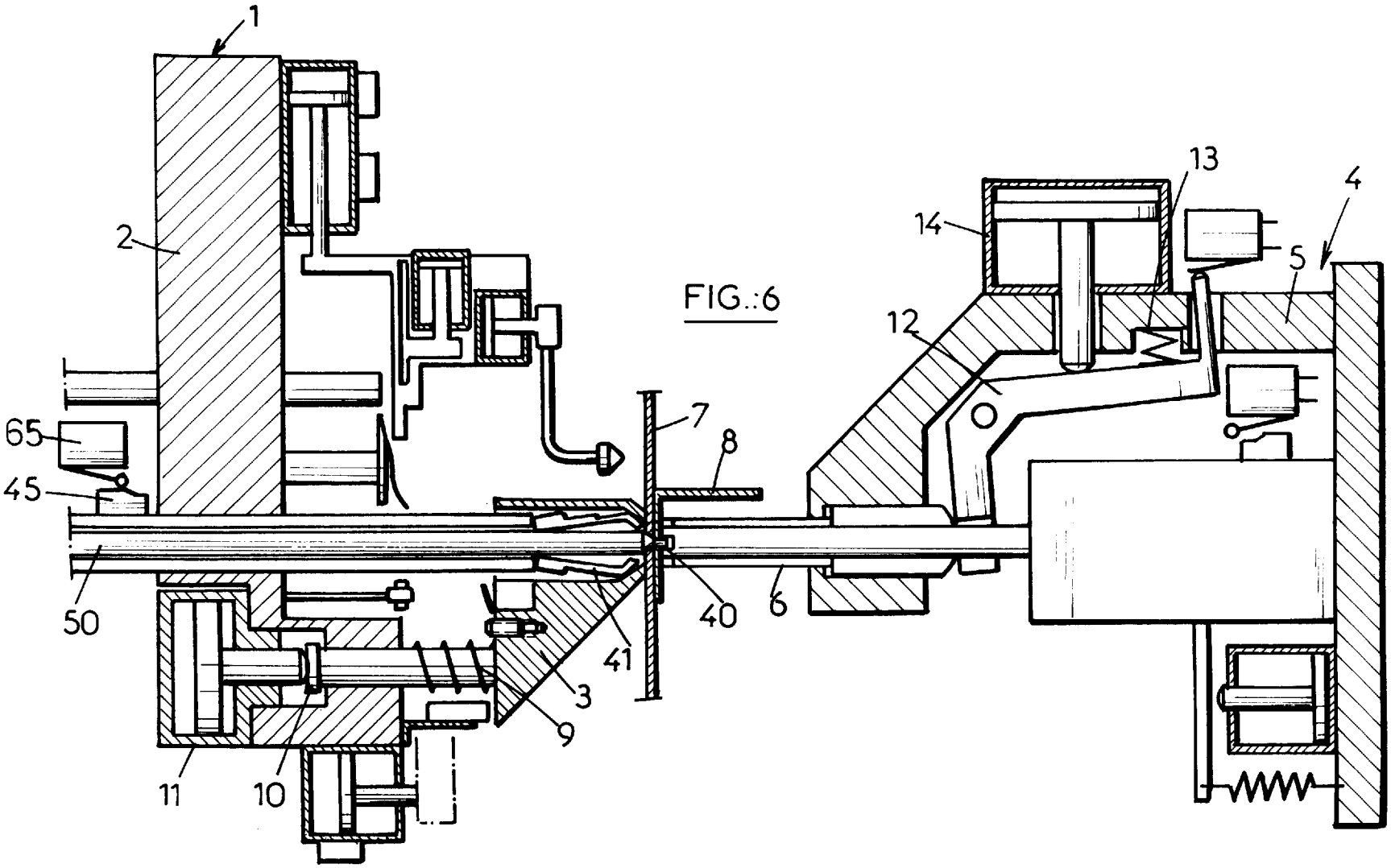

As FIG. 6 shows, the set of tongs or rivet carrier 41 has an axial motion along the axis of the hole. It is displaced until it brings the rivet 40 into the hole and opens at this moment. A snap 50, which forms part of the hammer and is coaxial with the set of tongs 41 then comes to rest on the head of the rivet 40. A contactor 65 actuated by a cam 45 integral with the set of tongs controls the position of the latter.

Figure 7:
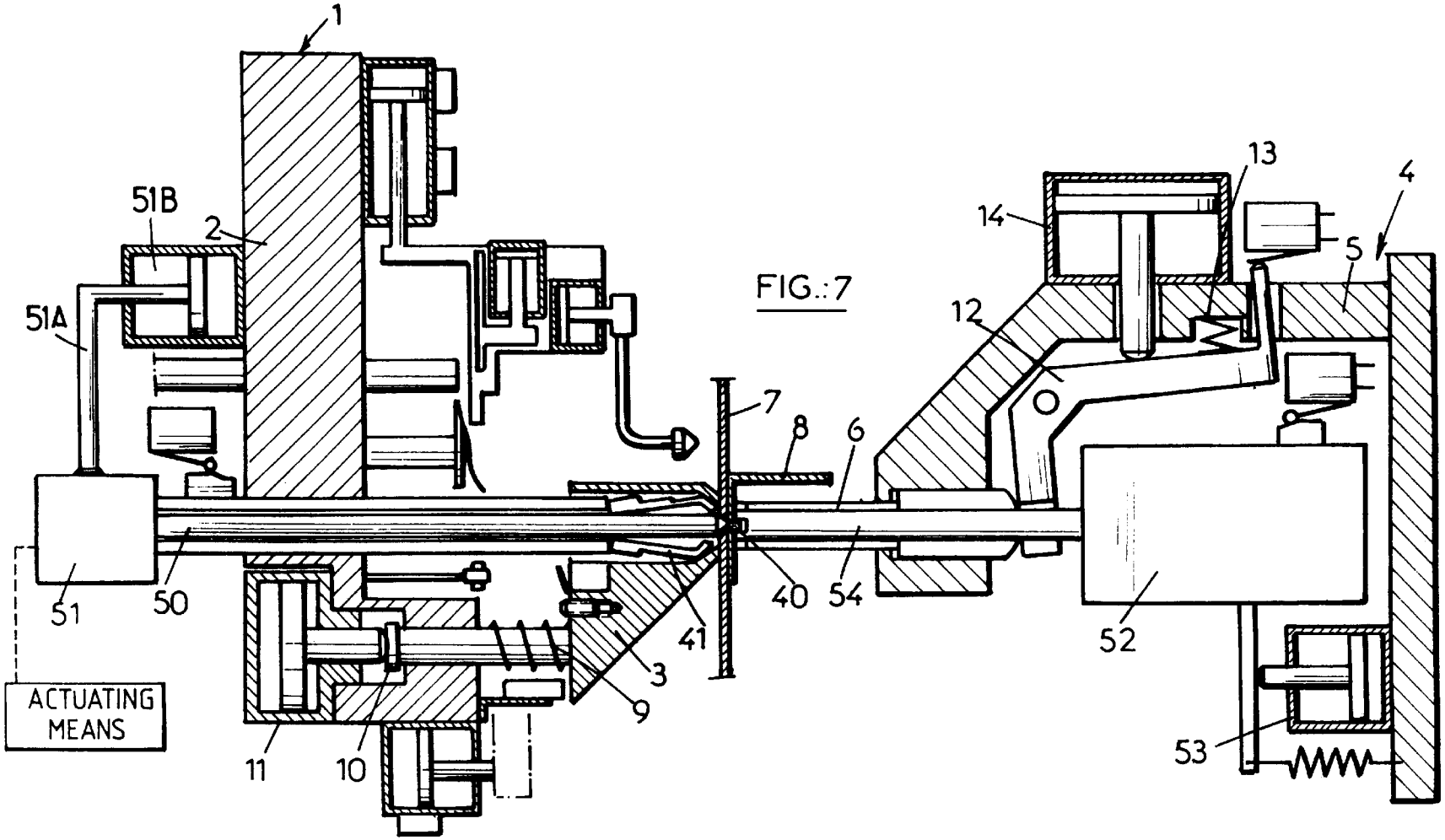

FIG. 7 shows the riveting operation proper. On the one hand, the riveting hammer 51 integral with the snap 50 has gone into action and, on the other hand, on the working head 4, the reaction dolly 52 has been displaced axially under the action of a cylinder 53 and the reaction rod 54, integral with the dolly, has been displaced until it has come into contact with the end of the rivet 40, passing through the sheet-holding device 6. The riveting hammer is controlled by suitable actuating means 51A which are known in the art such as pneumatic, electromagnetic or ultrasonic.

After the forming of the rivet, the operation is finished and the frames 2 and 5 move apart, taking the sheet-holding devices 3 and 6 with them, the pressure to the cylinders 11 and 14 for actuating these sheet-holding devices being shut off.

Figures 8, 9:
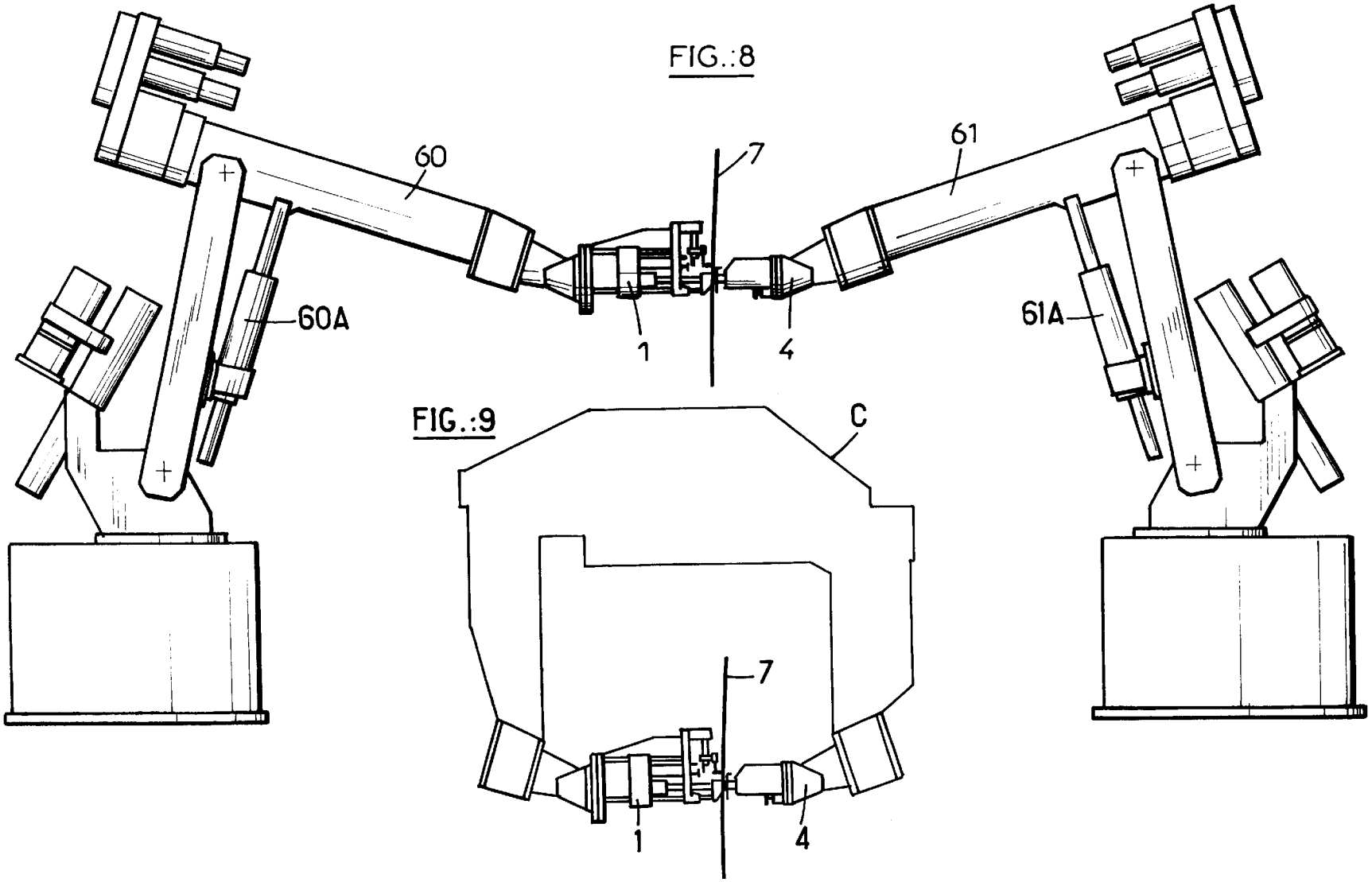
FIG. 8 is a view in elevation showing the tool assembly mounted on two robot arms.
FIG. 9 is a view similar to FIG. 8 but showing the tool assembly mounted on a "C" shaped structure.

FIG. 8 shows, on a different scale, the arrangement of the working heads 1 and 4, each mounted on a robot arm 60, 61. During the operation, the brakes of the two robot arms are locked, thus ensuring the immobilization of the frames 2 and 5. It will be noted that the force which is exerted on the robot arms corresponds to that which is exerted by the cylinders 11 and 14 on the sheet-holding devices, namely about 1500 N, a force which does not require any reinforcement of these robot arms. As is well known in the art, the motion of the robot arms is accomplished by electrical motors 60A, 61A equipped with brakes. The brakes are applied as soon as electrical power is switched off (see FIG. 8).

Of course, the invention is capable of numerous variants. For example, instead of making provision for the different tools of each of the working heads to be displaced linearly by cylinders to bring them into the active position or withdraw them from it, provision can be made for the frame to carry a carrousel which successively brings the different tools, or certain of them, into place.

The hammer can be of the low-frequency multi-strike type, which is common and simple to use but is noisy and the shocks from which are in part transmitted to the robot arms. It can be of the single-strike type, which is more rapid but gives rise to more significant shocks. In the case where an electric or electromagnetic hammer is used, it is possible, for example where head less rivets of the "SLUG" type or some other type are used, to replace the reaction dolly with a second hammer electronically synchronized with the first. And lastly, it is possible to use riveting tools functioning at ultrasonic frequency (20 to 40 kHz).

The different tools described, such as, for example, the rivet-feeding means or the riveting tool proper, can be of any conventional type. This is why they have not been described in more detail here.

What is claimed is:

1. Tool assembly for drilling and riveting parts, comprising:

a support structure including a pair of moveable robot arms which are lockable in position, a first and a second frame, mounted opposite each other, each on one of said robot arms, a pair of sheet-holding devices each mounted on one of the frames, first means provided on each of said first and second frames for displacing its respective one of the sheet-holding devices along an axis of movement towards the other sheet-holding device and for exerting a small force along said axis of movement between said sheet holding devices, each of said sheet-holding devices being provided with second means located between said sheet-holding device and the corresponding frame for applying a higher force, along said axis of movement, and against the other sheet holding device, said higher force being sufficient for holding together said parts during a drilling operation, each of said sheet-holding devices being also provided with sensor means responsive to displacement of said sheet-holding device upon contact with one of said parts, each said sheet-holding device being maintained for movement relative to its respective frame only in a direction toward and away from said other sheet-holding device, at least one drill mounted on a support which is articulated on one of said frames, means for displacing said drill relative to said one frame in a direction toward and away from said other frame and said parts to be riveted, means for pivoting said support about an axis parallel to said axis of movement for displacing said drill between a rest position and an active position wherein said active position is coaxial to said axis of movement of the corresponding sheet-holding device, means for placing a rivet in a hole drilled by the drill, these means being carried by one of said frames and provided with means for displacing said means for placing a rivet relative to said one frame between an active position for placing a rivet in said hole and a rest position spaced from said hole by a movement comprising a rectilinear displacement in a direction toward and away from the other frame, a percussion riveting hammer carried by one of the said first and second frames, means for displacing said hammer relative to said one frame between an active position where it engages a rivet placed in said hole and a rest position spaced from said hole by a movement comprising a rectilinear displacement thereof in a direction toward and away from the other frame, and a counter-piece carried by the one of said first and second frames which is not carrying said hammer and integral with a reaction dolly and means including a fluid actuated cylinder for displacing said counter-piece relative to said one frame between an active position and a rest position;

the sheet-holding device which is opposed to the drill having vents for discharging chips.

2. Assembly according to claim 1, including at least one pneumatic cylinder means for controlling the movement of at least said drill relative to said one frame.

3. Assembly according to claim 1, in which at least one of the frames carries a means for placing a sealing agent into said hole, this means being displaceable between an active position proximate said sheet-holding devices and said hole and a rest position spaced from said sheet-holding devices and said hole.

4. Assembly according to claim 1, in which the riveting hammer is pneumatically actuated.

5. Assembly according to claim 1, in which the riveting hammer is electrically actuated.

6. Assembly according to claim 1, in which the riveting hammer is of the type functioning at ultrasonic frequency.

7. Assembly according to claim 1, in which the sheet holding devices, the means for placing the rivet, the riveting hammer and the reaction dolly are in the same orientation relative to their respective frame when passing from the rest position to the active position.

8. Assembly according to claim 7, in which the sheet-holding devices, the means for placing the rivet, the riveting hammer and the reaction dolly are displaced generally along the axis of movement and said at least one drill is mounted to move in at least one displacement generally perpendicular to the axis of the hole in order to pass from the rest position to the active position.

9. Assembly according to claim 1 wherein said means for displacing said counterpiece relative to said other frame provides only a rectilinear displacement toward the other frame.

10. Assembly according to claim 1 wherein said drill and said percussion riveting hammer are carried by the same frame.

11. Assembly according to claim 1 in which said first means is a biasing means between each sheet holding device and its respective frame.

12. Process for assembling, drilling and riveting parts, comprising the following steps:

providing a tool assembly for drilling and riveting parts, comprising:

a support structure including a pair of robot arms, a first and a second frame, mounted opposite each other, each on one of said robot arms, a pair of sheet-holding devices each mounted on one of the frames, first means provided on each of said first and second frames for displacing its respective sheet holding device along an axis of movement towards the parts to be riveted and for exerting a small force along said axis of movement between said sheet-holding devices, each of said sheet-holding devices being provided with second means located between said sheet-holding device and the corresponding frame for applying a higher force, along said axis of movement, sufficient for holding together said parts during a drilling operation, each of said sheet-holding devices being also provided with sensor means responsive to displacement of said sheet-holding device upon contact with one of said parts, said sheet-holding devices being maintained for movement relative to their respective frame only in a direction toward and away from said parts to be riveted, at least one drill mounted on a support which is articulated on one of said frames, means for displacing said drill relative to said one frame in a direction toward and away from said other frame and said parts to be riveted, with means for pivoting said support about an axis parallel to said axis of movement for displacing said drill between a rest position and an active position which is coaxial to said axis of movement of the corresponding sheet-holding device, means for placing a rivet in a hole drilled by the drill, these means being carried by one of said frames and provided with means for displacing said means for placing a rivet relative to said one frame between an active position and a rest position by a movement comprising a rectilinear displacement in a direction toward and away from the other frame, a percussion riveting hammer carried by one of the said first and second frames, means for displacing said hammer relative to said one frame between an active position and a rest position by a movement comprising a rectilinear displacement thereof in a direction toward and away from the other frame, and a counter-piece carried by the one of said first and second frames which is not carrying said hammer and integral with a reaction dolly and means including a fluid actuated cylinder for displacing said counter-piece relative to said one frame between an active position and a rest position;

the sheet-holding device which is on the side opposite to the drill having vents for discharging chips, each of said robot arms having a brake to hold it in a fixed position relative to the other robot arm;

bringing the two sheet-holding devices into contact with opposite faces of the parts to be assembled by displacing at least one of the robot arms and then maintaining said robot arms in fixed positions, holding the parts to be assembled by said first means being biased toward each other with a force sufficient to hold said parts in position; clamping the parts by actuating said second means to apply a higher force to prevent relative displacement of said parts during a subsequent drilling operation, a reaction to said higher force being provided by said robot arms being maintained in said fixed positions, drilling and riveting the parts thus clamped without interrupting the clamping.

* * * * *